US011435147B2

(12) United States Patent
Girardi et al.

(10) Patent No.: US 11,435,147 B2
(45) Date of Patent: Sep. 6, 2022

(54) FLUID DISTRIBUTOR ASSEMBLY FOR HEAT EXCHANGERS

(71) Applicant: BITZER Kuehlmaschinenbau GmbH, Sindelfingen (DE)

(72) Inventors: Simone Girardi, Colleferro (IT); Matteo Munari, Padua (IT); Luca Corradin, Padua (IT)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 212 days.

(21) Appl. No.: 16/672,995

(22) Filed: Nov. 4, 2019

(65) Prior Publication Data

US 2020/0064085 A1 Feb. 27, 2020

Related U.S. Application Data

(63) Continuation of application No. PCT/EP2018/061364, filed on May 3, 2018.

(30) Foreign Application Priority Data

May 4, 2017 (EP) ..... 17425047

(51) Int. Cl.
*F28F 9/02* (2006.01)
*F28D 7/16* (2006.01)
*F28F 13/06* (2006.01)

(52) U.S. Cl.
CPC ..... *F28F 9/0275* (2013.01); *F28D 7/1607* (2013.01); *F28F 9/0265* (2013.01); (Continued)

(58) Field of Classification Search
CPC .... F28F 9/0265; F28F 9/0278; F28F 2230/00; F25B 39/028
See application file for complete search history.

(56) References Cited

U.S. PATENT DOCUMENTS 2,843,367 A 7/1958 Bogus et al.
5,419,391 A 5/1995 Chan et al.
(Continued)

FOREIGN PATENT DOCUMENTS

CN 102954628 A 3/2013
JP 2001 241883 A 9/2001
(Continued)

*Primary Examiner* — Eric S Ruppert
(74) *Attorney, Agent, or Firm* — Reinhart Boerner Van Deuren P.C.

(57) ABSTRACT

A heat exchanger comprises a shell having an elongated shape and a cylindrical geometry. A first fluid, fed through one or more first inlet pipes, flows inside the shell and a second fluid, fed through at least one second inlet pipe, flows inside the shell in order to perform heat exchange with the first fluid. The heat exchanger also comprises a fluid distributor assembly placed at the first inlet pipes. The fluid distributor assembly is provided with a first perforated plate, in turn provided with first through holes, and with at least one second perforated plate, in turn provided with second through holes. The second perforated plate is disposed parallel and downstream of the first perforated plate with respect to the flow direction of the first fluid flowing into the first through holes and the second through holes. Between the first perforated plate and the second perforated plate a hermetic seal device is disposed. The first perforated plate and the second perforated plate are spaced from each other, in such a way that the first perforated plate and the second perforated plate, together with the hermetic seal device, surround an equalization chamber of predefined depth, measured along the flow direction of the first fluid flowing into the first through holes and the second through holes. Each equalization chamber is closed at the peripheral edges of the first perforated plate and of the second perforated plate.

14 Claims, 21 Drawing Sheets

(52) U.S. Cl.
CPC ..... *F28F 9/0273* (2013.01); *F28F 9/0278* (2013.01); *F28F 13/06* (2013.01)

(56) References Cited

U.S. PATENT DOCUMENTS

| | | | |
|---|---|---|---|
| 6,868,695 | B1 | 3/2005 | Dingel et al. |
| 9,310,143 | B2 | 4/2016 | Valente |
| 2014/0223936 | A1 | 8/2014 | Hartfield et al. |

FOREIGN PATENT DOCUMENTS

| | | | | | |
|---|---|---|---|---|---|
| JP | 2007170271 | A | * | 7/2007 | ..... F28D 7/16 |
| WO | WO 00/55552 | A1 | | 9/2000 | |
| WO | WO 2012/007344 | A2 | | 1/2012 | |

* cited by examiner

FLUID DISTRIBUTOR ASSEMBLY FOR HEAT EXCHANGERS

CROSS-REFERENCE TO RELATED PATENT APPLICATIONS

This application is a continuation of International application number PCT/EP2018/061364 filed on May 3, 2018.

This patent application claims the benefit of International application No. PCT/EP2018/061364 filed on May 3, 2018 and European patent application No. 17425047.2 of May 4, 2017, the teachings and disclosure of which are hereby incorporated in their entirety by reference thereto.

BACKGROUND OF THE INVENTION

The present invention refers to a fluid distributor assembly for a generic heat exchanger typology and, more specifically, for a shell-and-tube heat exchanger.

A heat exchanger is a device used to transfer heat between two or more fluids. A shell-and-tube heat exchanger usually comprises a plurality of tubes arranged parallel to each other in order to form one or more tube bundles 100 (see FIG. 1). The tube bundle 100 is axially inserted into a shell 102 having an elongated shape and a cylindrical geometry. A first fluid, fed through one or more first inlet pipes 104, flows inside the tube bundle 100 and a second fluid, fed through at least one second inlet pipe 106, flows inside the shell 102 in order to perform heat exchange with the first fluid through the walls of the tubes of the tube bundle 100.

The uniform distribution of the first fluid among all the tubes of the tube bundle is one of the objectives to be achieved in order to optimize the use of the heat exchanger surface. According to the heat exchanger typology, the fluid distribution can be the distribution of a refrigerant inside the tubes of a dry-expansion shell-and-tube evaporator, or the uniform distribution of the second fluid on the external surface of the tube bundle, e.g. the distribution of the refrigerant upon the external surface of the tubes in a falling-film shell-and-tube evaporator, or, in the case of a compact heat exchanger, i.e. a plate heat exchanger with open channels (also opened only from the side of the fluid to be distributed), the fluid distribution among the different parallel channels and within each channel. In case of the heat exchanger is an evaporator in which the fluid to be distributed is, for example, a refrigerant in the two-phase vapor-liquid physical state, the distribution of the fluid, both in terms of mass flow rate and vapor quality for tube/channel/channel section, is penalized by the different fluid-dynamic behavior between the two phases.

Heat exchangers are thus commonly provided with fluid distribution systems having one or both of the following objectives:

- to enlarge the refrigerant flow from a narrow section, more or less corresponding to the section of the inlet pipe(s) of the distribution system, to a wider section that has an extension approximately corresponding to the entire area in which are located the tubes or channels to be fed, i.e. internally to the tubes or channels, as in the case of a shell-and-tube or plate/plate-and-shell heat exchanger, or externally to the exchanging surface, as in the case of a falling film or spray film evaporator with a shell-and-tube type construction; and
- to generate a high pressure drop in the fluid to be distributed, wherein said high pressure drop is compatible with the functionality of the plant that includes the heat exchanger, so that the vapor quality at the entrance of the distribution system is as low as possible. In this way, also the corresponding void-fraction will have a lower value and the distribution of the fluid will benefit of the increased content of liquid. In the limit condition of vapor quality equal to zero, the distribution efficiency will be maximum.

In case of the fluid to be distributed is in a single-phase state, both liquid or vapor, the introduction in the distribution system of a high pressure drop localized at the entrance of each tube/channel/channel section (for example through orifices), wherein said high pressure drop is much greater than those corresponding to the crossing of the fluid along the entire heat exchanger length inside the headers and tubes or channels, will ensure a good distribution because there will be less influence of the path length difference of the "path-lines" in which the entire flow of the fluid is divided along the entire heat exchanger length (inlet header, tube/channel, outlet header). The generated pressure drop varies greatly with the type of application, so primarily considering the refrigerant type, the mass flow rate, the vapor quality, the temperature and/or the pressure.

Typical examples of fluid distribution systems according to the prior art are shown in the attached FIGS. 1 to 11. In FIGS. 1 and 2 the fluid distribution system consists of a flow-break disk 108 placed at the first fluid inlet pipe 104. In FIG. 3 the fluid distribution system consists of a flow-break perforated disk 110. In FIGS. 4 and 5 the fluid distribution system consists of a pre-chamber 112 obtained using a single perforated plate 114 adherent to the tube-sheet, or placed at a certain distance from the tube-sheet, with or without a flow-break perforated disk 110. In FIGS. 6 and 7 the fluid distribution system consists of a pre-chamber 112 obtained using a single device 116 for each tube/channel/channel section with calibrated orifice per device, with or without a flow-break perforated disk 110. In FIGS. 8 and 9 the fluid distribution system consists of a pre-chamber 112 and at least a subsequent chamber 118 obtained assembling a number of perforated plates 120 (with a symmetric or asymmetric holes distribution) at a pre-defined distance from each other, with or without a flow-break perforated disk 110. Finally, in FIGS. 10 and 11 the fluid distribution system consists of a pre-chamber 112 and a perforated plate 122 with a capillary tube for each tube/channel/channel section, wherein an equalization chamber 124, formed between the perforated plate 122 and the inlet header or tube-sheet, can be present or not.

Document U.S. Pat. No. 9,310,143 of the same Applicant describes a system for a distribution coolant fluid using at least two impingement plates with a plurality of through holes placed in succession between each first inlet hole and the tube plate. Mentions that typically the number of through holes in a second plate is equal to the number of tubes and that the number of through holes of the first plate can be greater, smaller or the same with the respect to the number of tubes.

Document U.S. Pat. No. 6,868,695 describes a flow distributor for an evaporator having at least three perforated plates defining chambers to ensure even distribution of liquid refrigerant. Document US 2014/0223936 describes a construction of a refrigerant displacement array consisting of a series of alternating spacers and perforated baffle plates. Document CN 102954628 describes a liquid distributor for an evaporator having staggered perforated distribution plates.

All the above fluid distribution systems according to the prior art have more or less important drawbacks. For example, fluid distribution systems of the type shown in FIGS. 1-3 may cause an inefficient distribution of the fluid. With the fluid distribution systems of FIGS. 4-7 an efficient distribution can be obtained only in a limited range of applications, due to a limit of manufacturing at a low cost. The limit is linked to the possibility that a single hole, or a single orifice, can have a size that can be manufactured with a low cost technology (e.g. punching) and generate the required pressure drop for the specific application.

With the fluid distribution systems of FIGS. 8 and 9 too an efficient distribution can be obtained only in a limited range of applications, due to a limit of manufacturing at a low cost. In order to ensure that the perforated plates with intermediate open chambers do not deform under the effect of pressure, it would be necessary to increase the thickness of the plates, thus making it difficult and expensive their drilling. Furthermore, with open chambers it is impossible to keep under control the flow of refrigerant that by-passes the holes of the perforated plates, making highly inefficient the fluid distribution system. This inefficiency is greater the more the distribution system works with a high pressure drop. The bending of the perforated plates under the pressure creates a condition of variable geometry that makes it difficult the prediction of the operation of the component.

With the fluid distribution systems of FIGS. 10 and 11 a good fluid distribution can be obtained, but with a high manufacturing cost due to the fixing process of the various capillary tubes to the main plate. In this case, the fluid distribution is efficient in a wider range of applications compared to previous solutions, but the full range cannot be covered. In the special cases in which the refrigerant flow rate is very low, in order to obtain the useful pressure drop to have a good distribution, very small holes for the capillary tubes should be used, with the risk of occluding so small holes. One possibility of solving the problem would be to increase the length of the capillary tube, but in this case there would be an equivalent waste of useful length of the heat exchanger tubes, equivalent to the distance between the tube-sheet and the terminal position of the capillary within the tube. Anyway, all the prior art fluid distribution systems according to FIGS. 1-11 can have the problem of reverse flow instability in some particular operating conditions.

SUMMARY OF THE INVENTION

One object of the present invention is therefore to provide a fluid distributor assembly for a heat exchanger device which is capable of resolving the above mentioned drawbacks of the prior art in a simple, inexpensive and particularly functional manner.

In detail, one object of the present invention is to provide a fluid distributor assembly for a heat exchanger which is capable of performing a good distribution of the fluid.

Another object of the present invention is to provide a fluid distributor assembly for a heat exchanger which is capable of providing a wide variability of configurations in the assembly phase of its sub-components, in order to ensure an optimal solution for each specific application in a wide possible range.

A further object of the present invention is to provide a fluid distributor assembly for a heat exchanger which is capable of maintaining a constant geometry during operation.

Still another object of the present invention is to provide a fluid distributor assembly for a heat exchanger which provides the possibility of assembling the sub-components in order to minimize, or even eliminate, the reverse flow instability problems.

These objects are achieved according to the present invention by providing a fluid distributor assembly for a heat exchanger as set forth in the attached claims.

Further characteristics of the invention are underlined by the dependent claims, which are an integral part of the present description.

BRIEF DESCRIPTION OF THE DRAWINGS

The characteristics and advantages of a fluid distributor assembly for a heat exchanger according to the present invention will be clearer from the following exemplifying and non-limiting description, with reference to the enclosed schematic drawings, in which.

DETAILED DESCRIPTION OF THE INVENTION

Figure 1:
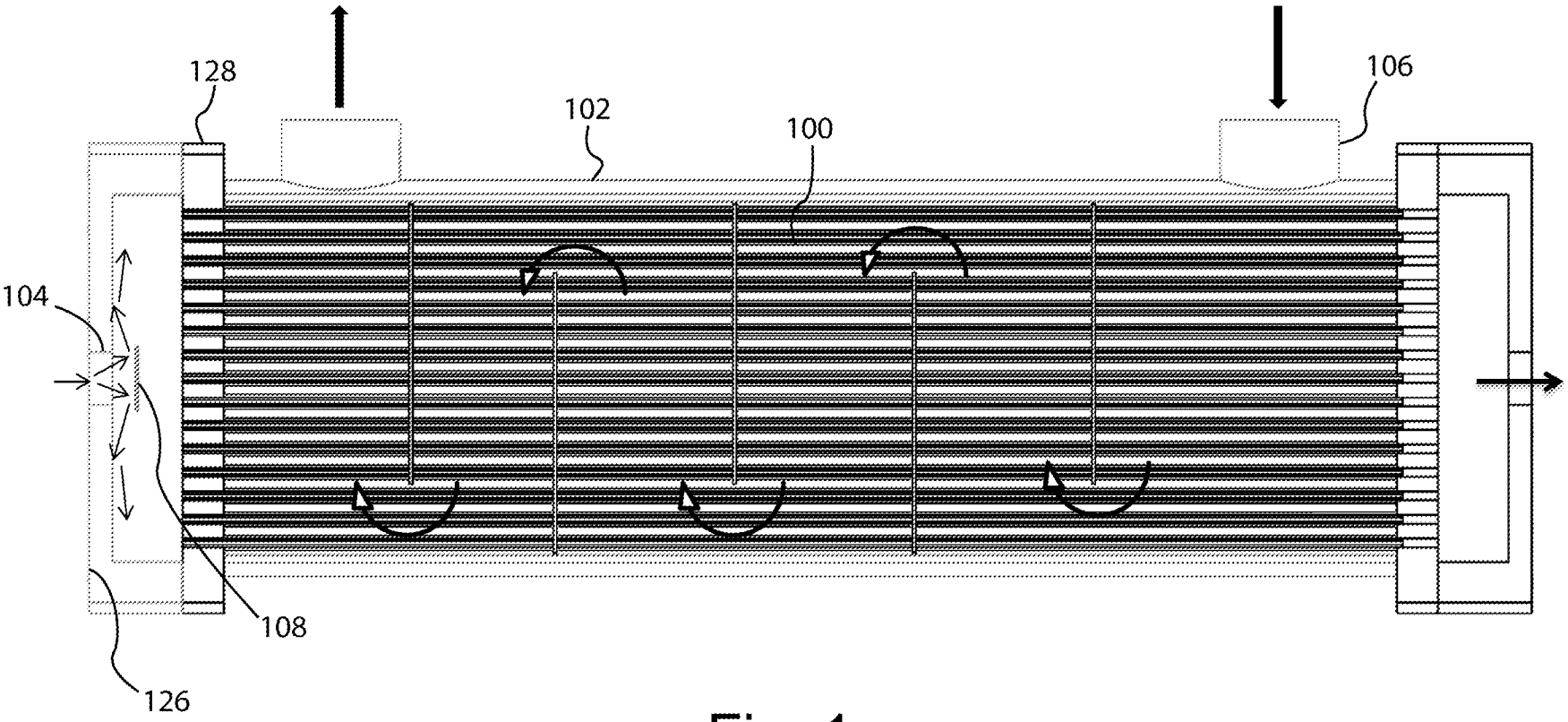
FIGS. 1-11 show different configurations of fluid distribution systems according to the prior art.
Figure 2:
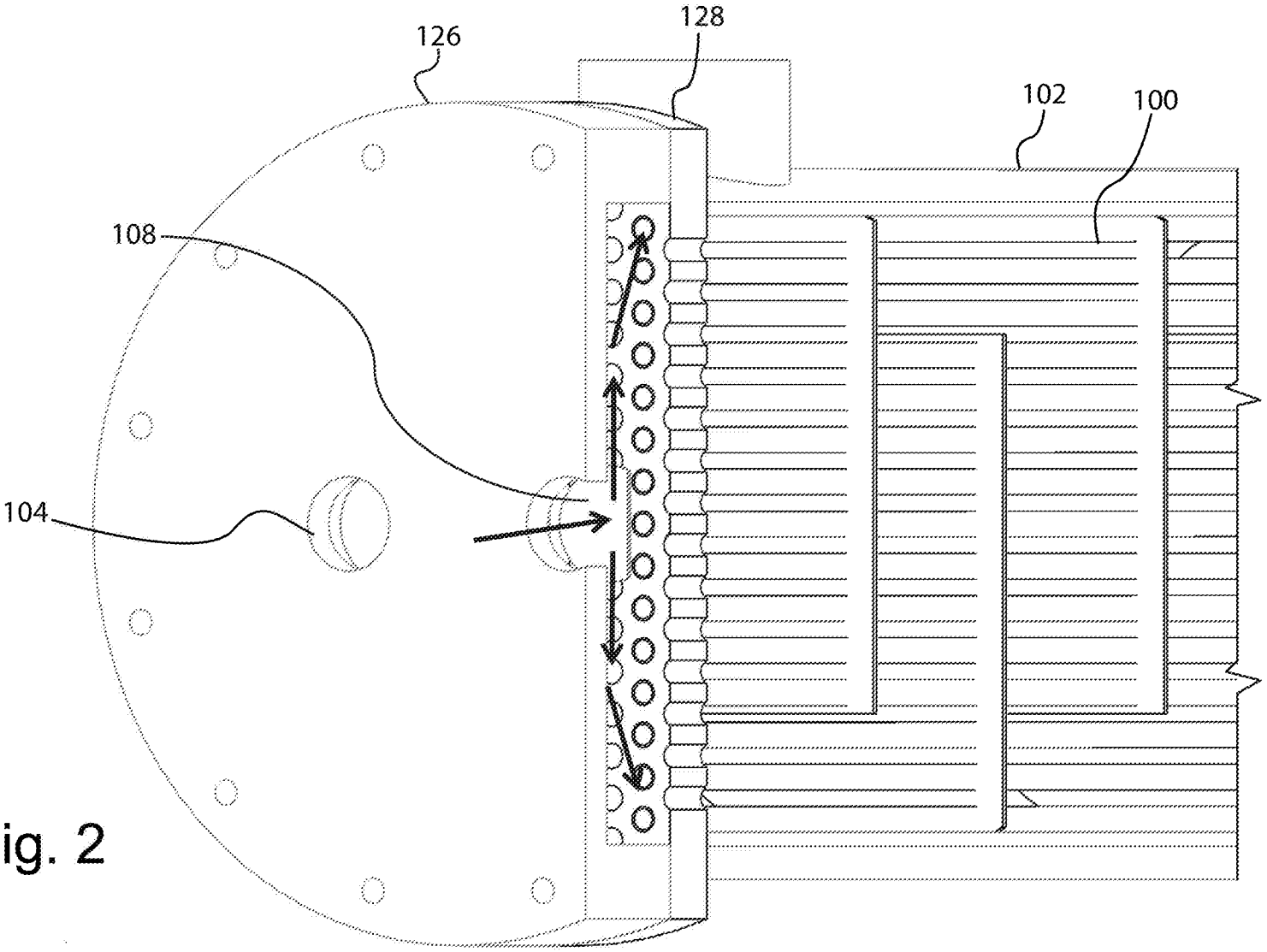
Figure 3:
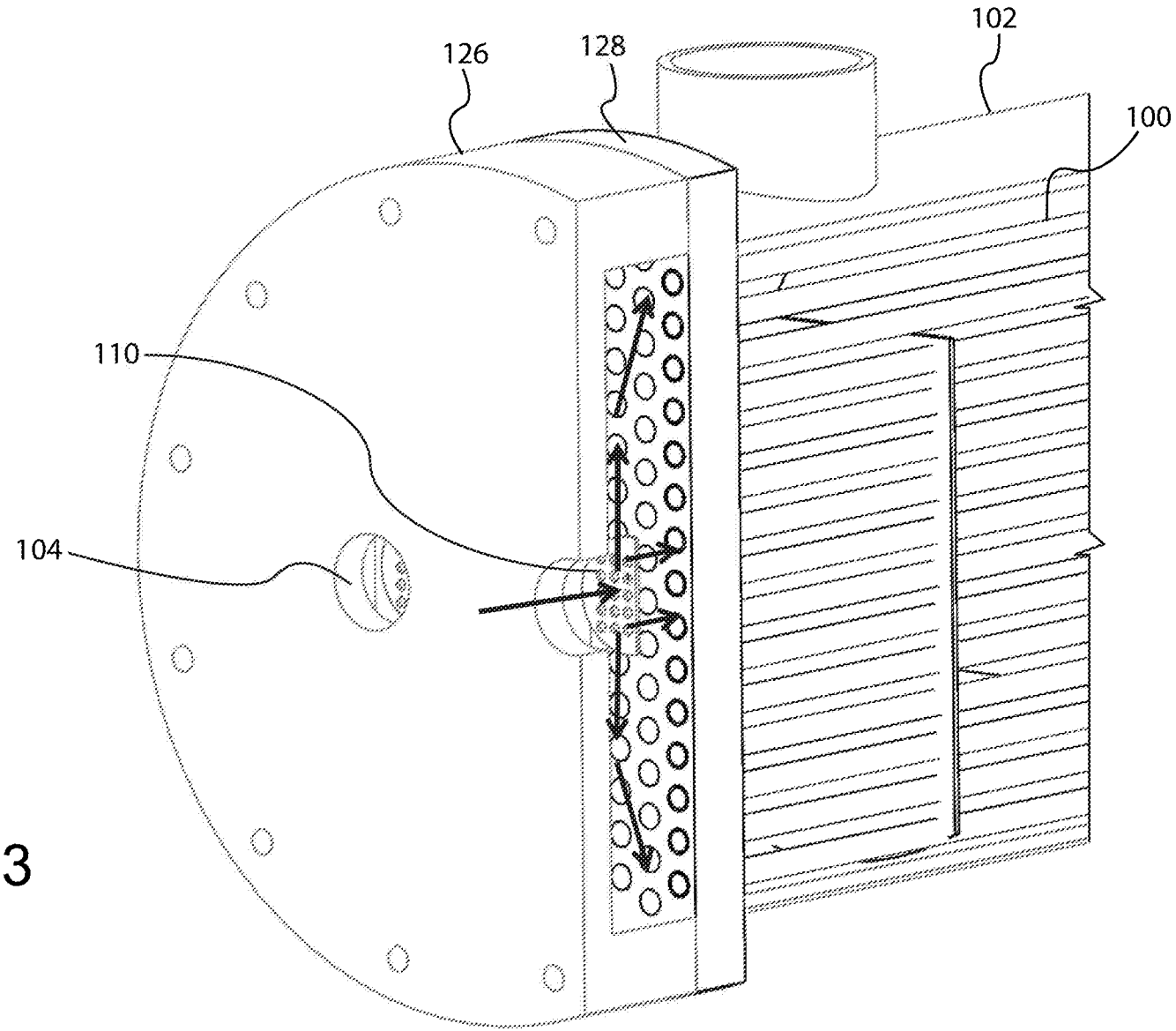
Figure 4:
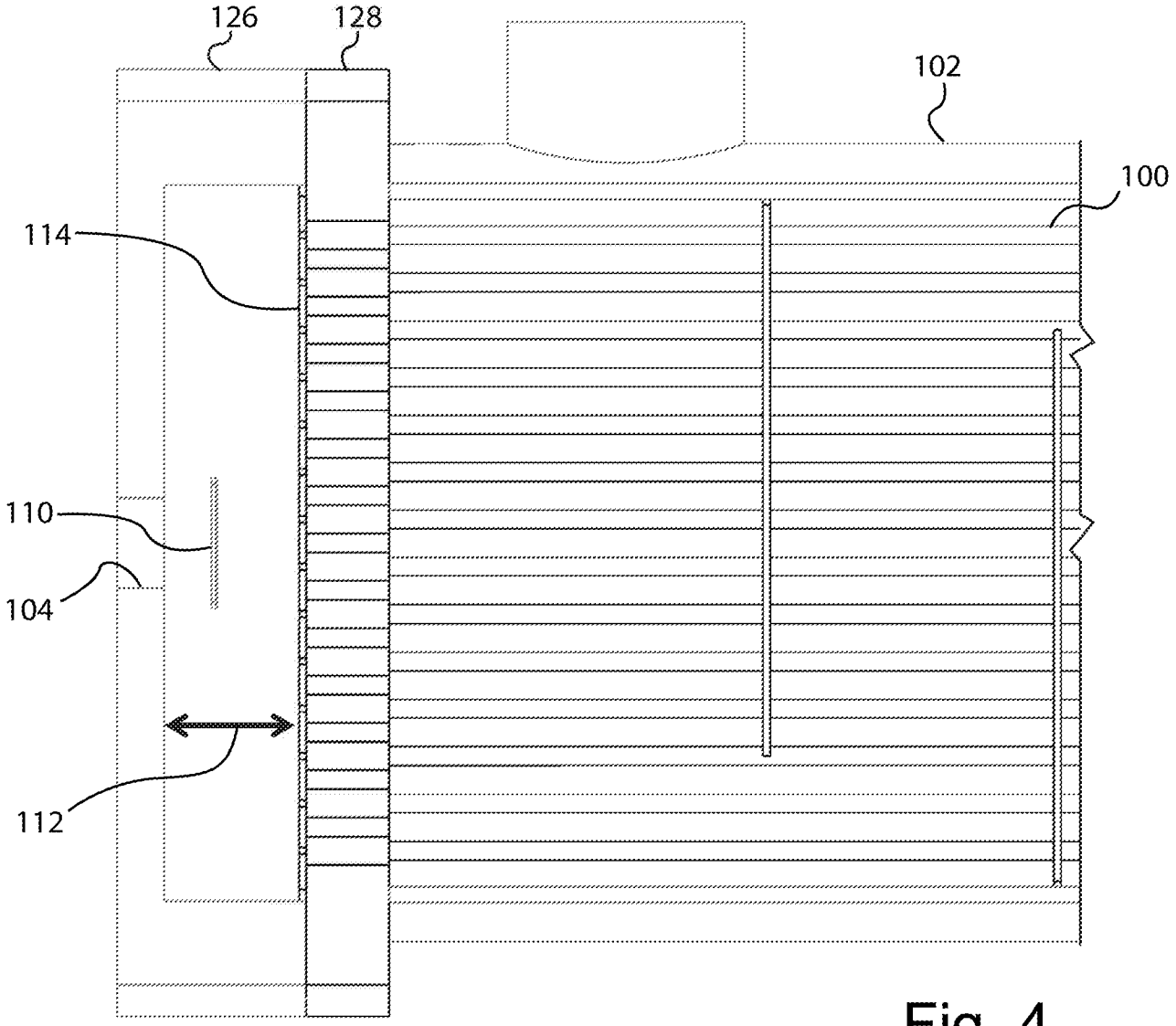
Figure 5:
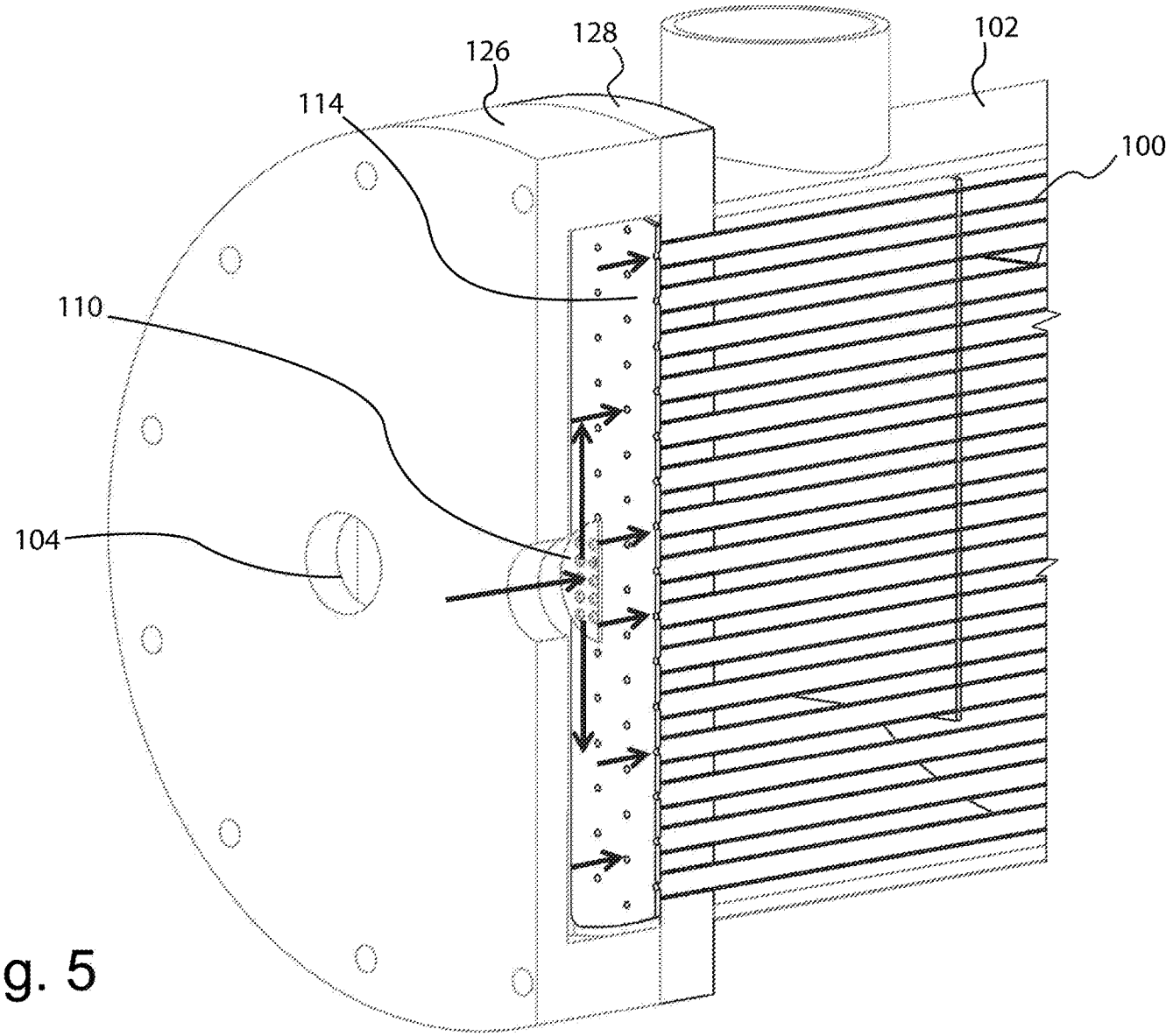
Figure 6:
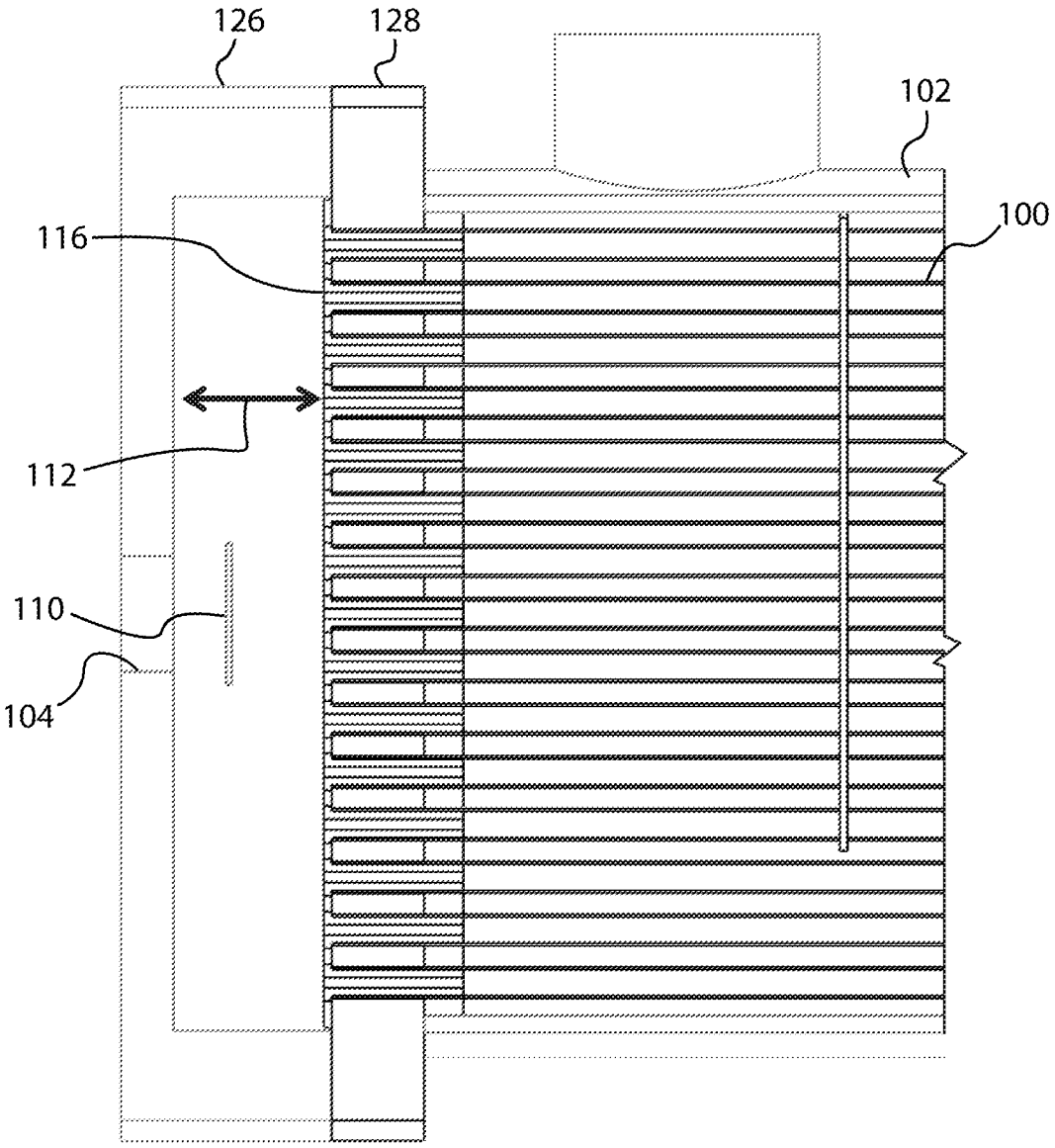
Figure 7:
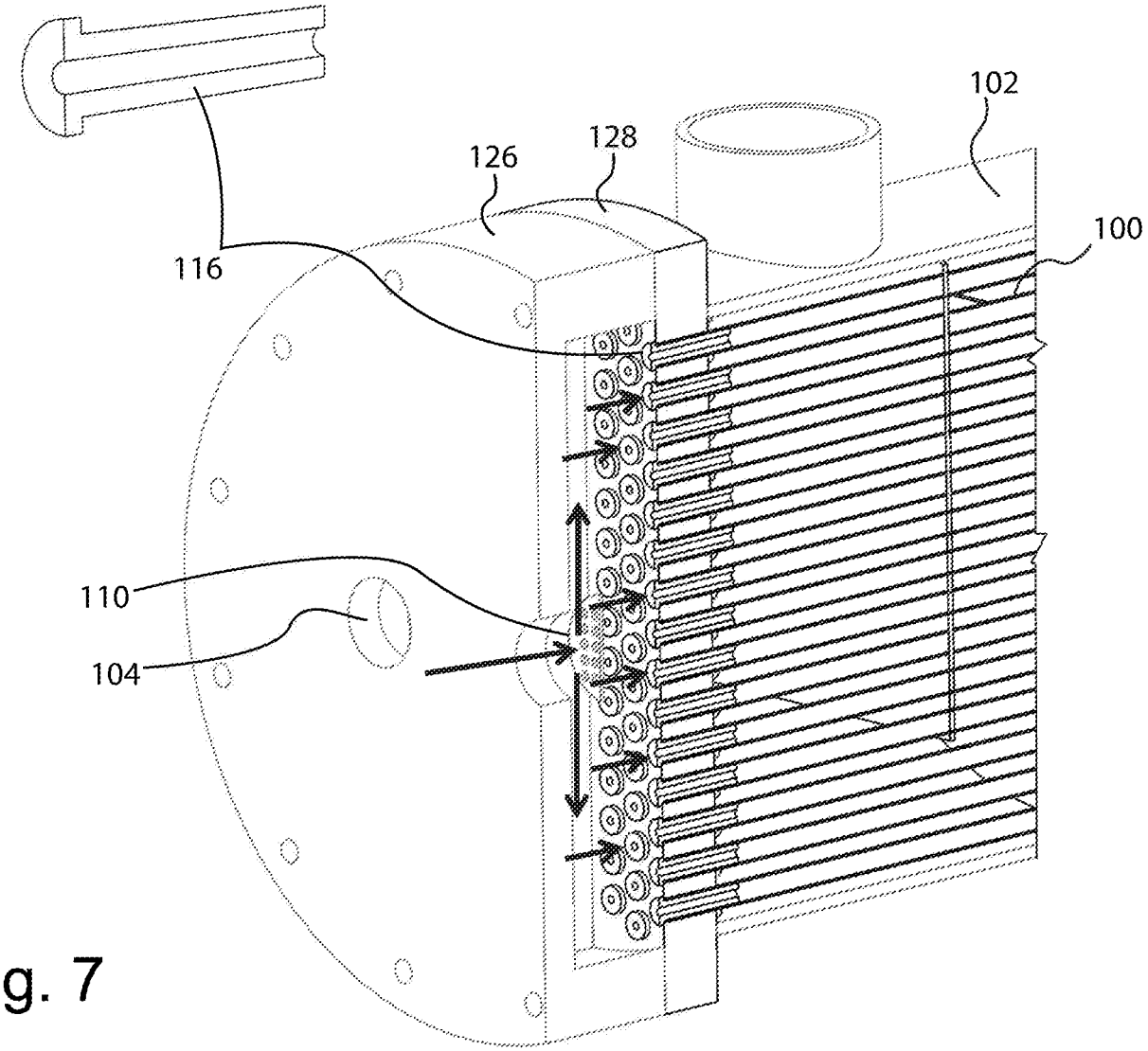
Figure 8:
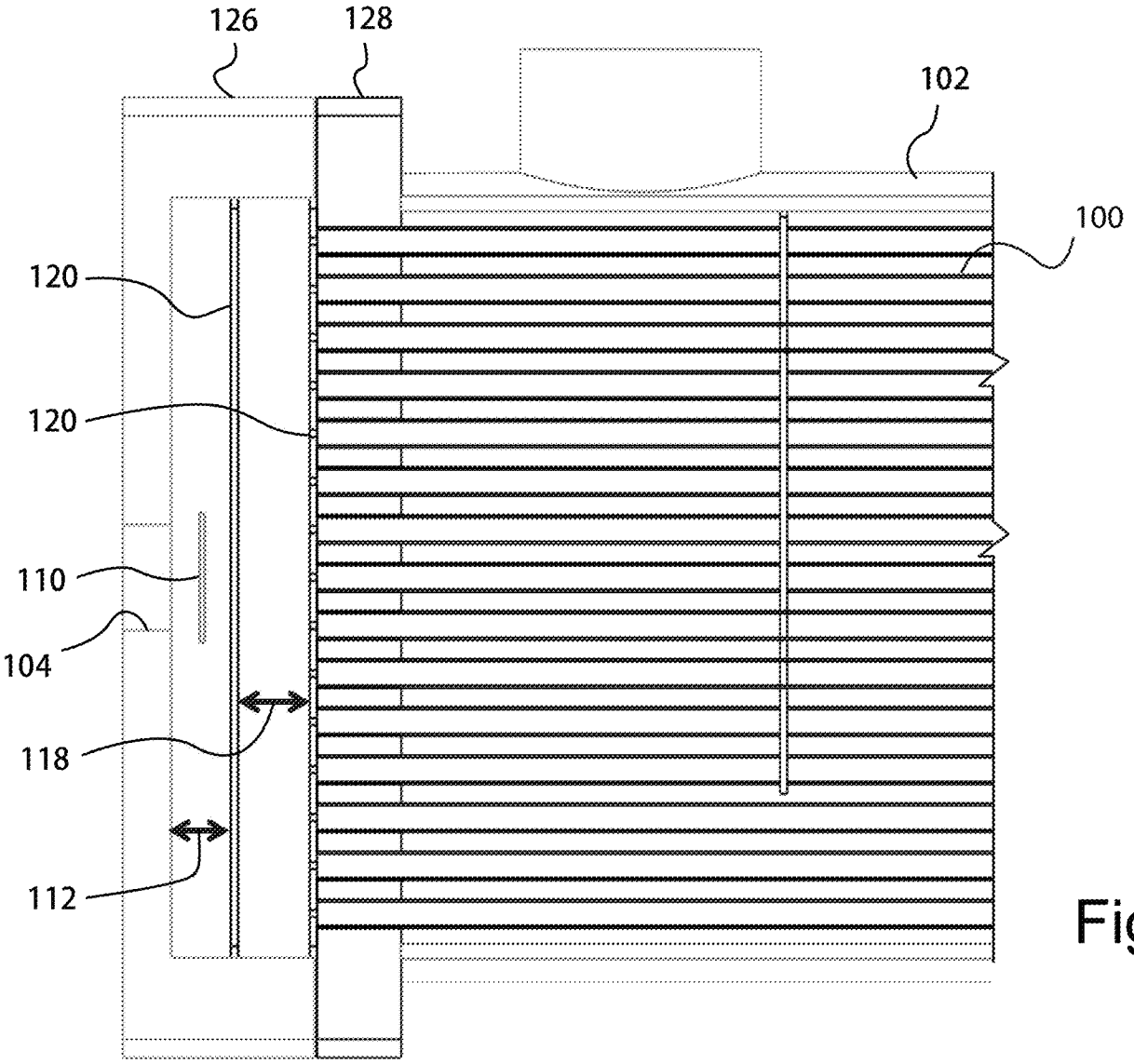
Figure 9:
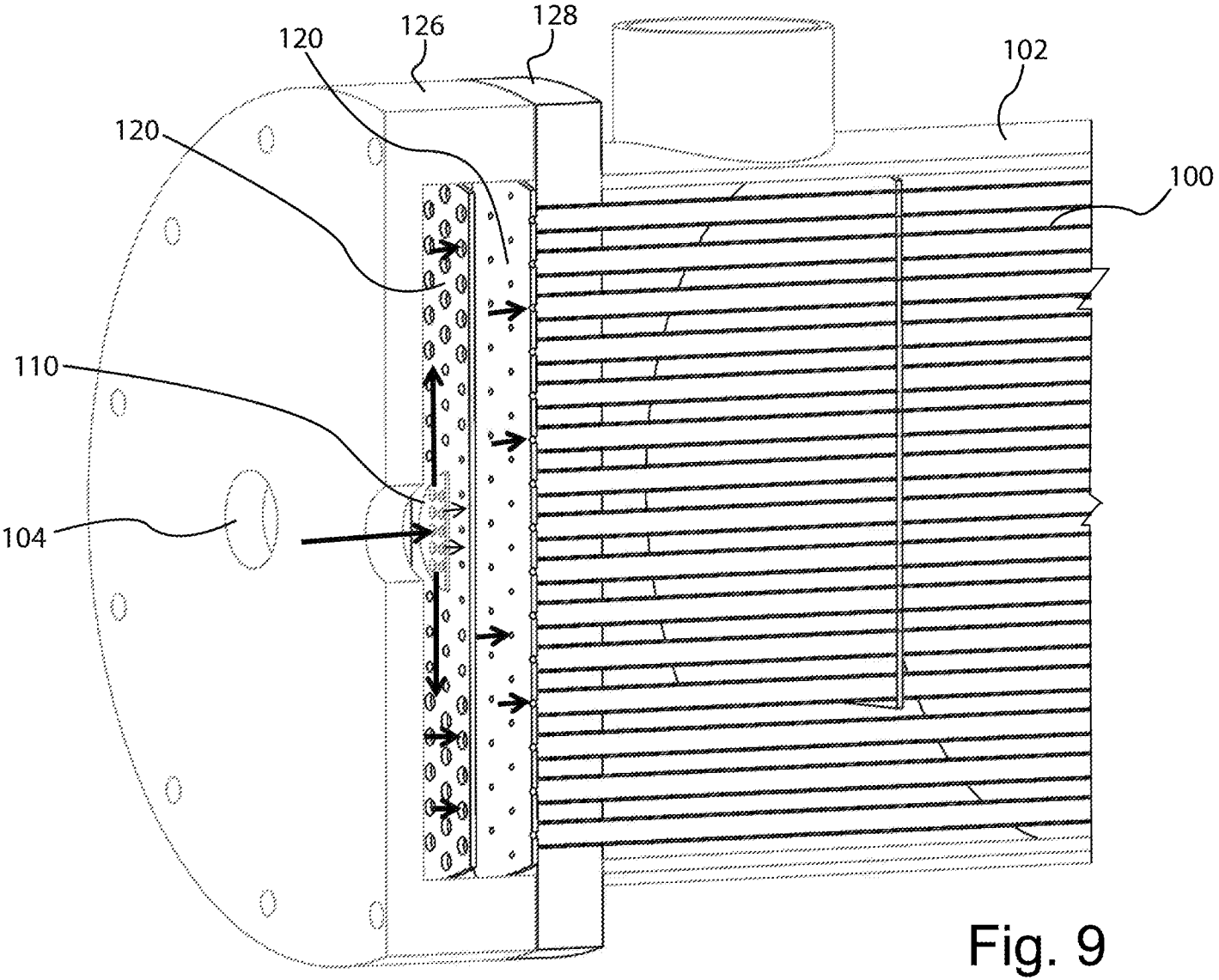
Figure 10:
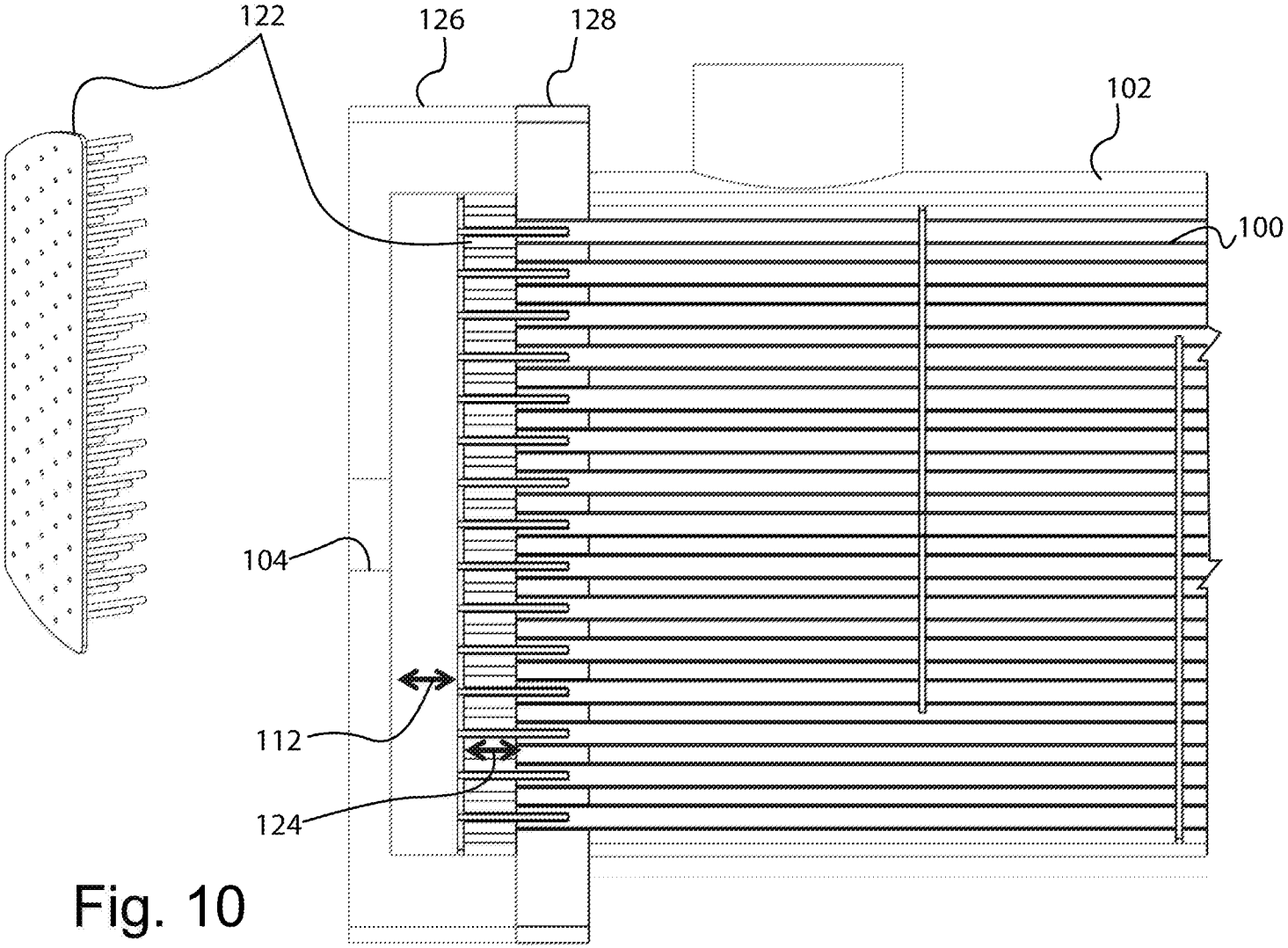
Figure 11:
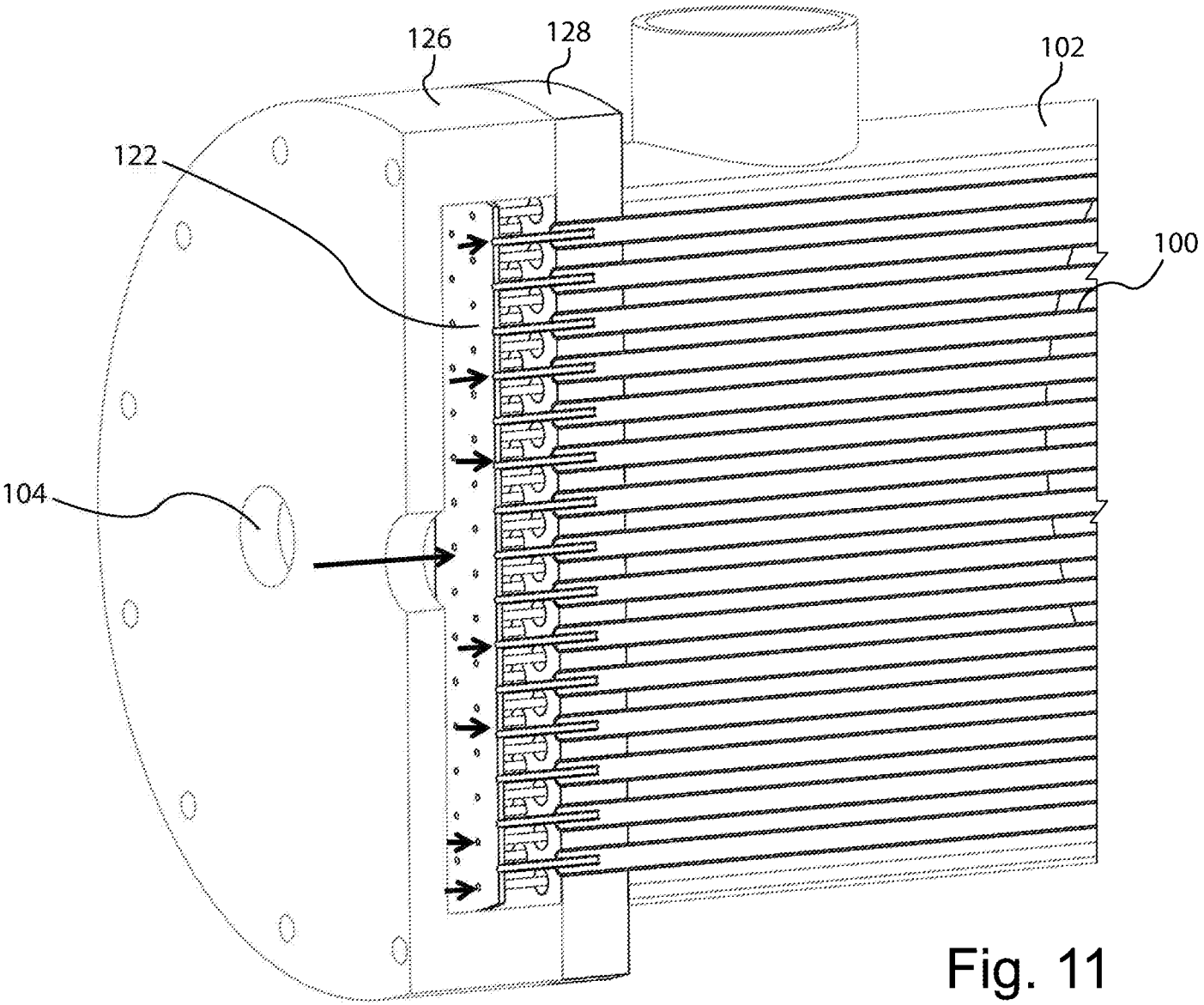
Figure 12:
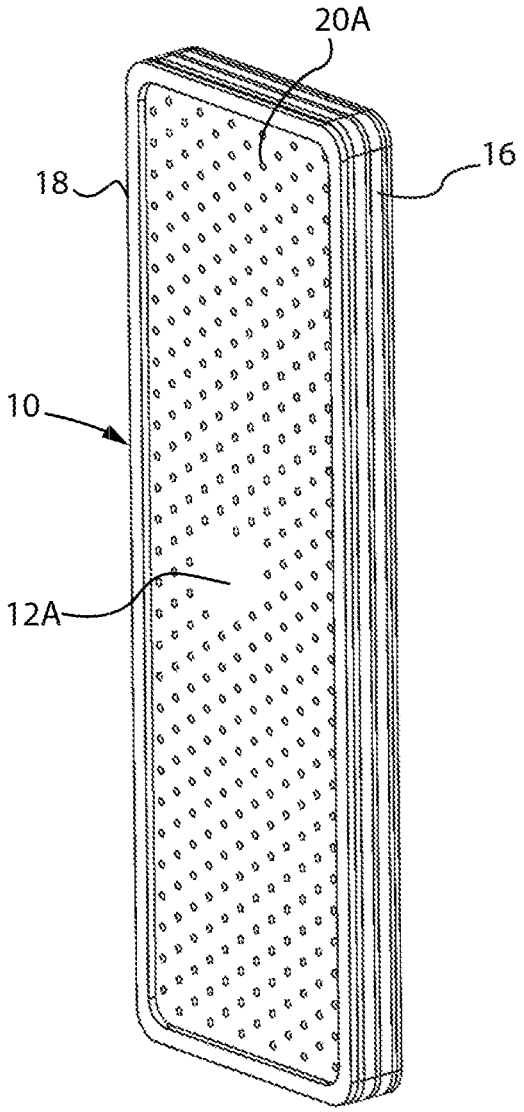
FIG. 12 is a schematic view of a preferred embodiment of the fluid distributor assembly for a heat exchanger according to the present invention.

With reference to FIGS. 12-21, some embodiments of the fluid distributor assembly 10 for a heat exchanger according to the present invention are shown. Such a heat exchanger is a shell-and-tube heat exchanger and is shown with illustrative but not limiting purposes. The shell-and-tube heat exchanger is of the type comprising a plurality of tubes arranged parallel to each other in order to form one or more tube bundles 100. Each tube bundle 100 is axially inserted into a shell 102 having an elongated shape and a cylindrical geometry. The tubes of the tube bundle 100 can be of any shape, like U-shaped or straight.

A first fluid, fed through one or more first inlet pipes 104 obtained in a head portion 126 of the shell-and-tube heat exchanger, flows inside the tube bundle 100 and a second fluid, fed through at least one second inlet pipe 106, flows inside the shell 102 in order to perform heat exchange with the first fluid through the walls of the tubes of the tube bundle 100. At least one end of each tube of the tube bundle 100 is joined to an inlet tube-sheet 128, disposed downstream of the head portion 126 (with respect to the flow direction of the first fluid entering the one or more first inlet pipes 104) and provided with respective tube-sheet bores 130 for inletting the first fluid in the tubes of the tube bundle 100. The inlet tube-sheet 128 thus separates the second fluid from the first fluid.

The fluid distributor assembly 10 is placed at the one or more first inlet pipes 104 and, more specifically, between the head portion 126 and the inlet tube-sheet 128 of the shell-and-tube heat exchanger. The fluid distributor assembly 10 consists in assembling an adequate number, greater than or equal to two, of perforated plates 12A, 12B, 12C, 12D, in such a way that in the space between two subsequent plates 12A, 12B an equalization closed chamber 14 is obtained. Each equalization closed chamber 14 is provided with a hermetic seal device 16 on the edges, in order to progressively improve the fluid distribution efficiency in the passage through each perforated plate 12A, 12B, 12C, 12D.

In other words, the fluid distributor assembly 10 is provided with a first perforated plate 12A, in turn provided with first through holes 20A, and with at least one second perforated plate 12B, in turn provided with second through holes 20B. The at least one second perforated plate 12B is disposed parallel and downstream of the first perforated plate 12A with respect to the flow direction A of the first fluid flowing into the first through holes 20A and the second through holes 20B. Between the first perforated plate 12A and the at least one second perforated plate 12B a hermetic seal device 16 is disposed. The first perforated plate 12A and the at least one second perforated plate 12B are spaced from each other, in such a way that the first perforated plate 12A and the at least one second perforated plate 12B, together with the hermetic seal device 16, surround an equalization chamber 14 of predefined depth, measured along the flow direction A of the first fluid flowing into the first through holes 20A and the second through holes 20B. Each equalization chamber 14 is closed at the peripheral edges of the first perforated plate 12A and of the at least one second perforated plate 12B. The equalization chamber 14 progressively improves the fluid distribution efficiency in the passage through the first through holes 20A of the first perforated plate 12A and the second through holes 20B of the at least one second perforated plate 12B.

The hermetic seal device 16, and thus each equalization chamber 14, can be obtained with different construction ways, as it will be better explained hereinafter. For example, the hermetic seal device 16 can be obtained with one or more ring-spacers 16A, 16B each disposed between two subsequent perforated plates 12A, 12B, 12C, 12D at their peripheral edges. Each ring-spacer 16A, 16B can be manufactured with a metallic, or rubber, or plastic material. Each ring-spacer 16A, 16B can be assembled with the corresponding perforated plates 12A, 12B, 12C, 12D through a brazing, or welding, or gluing process, or using gaskets or interference joints.

Preferably, the first through holes 20A of the first perforated plate 12A are staggered with respect to the second through holes 20B of the at least one second perforated plate 12B. In general, the through holes 20A, 20B, 20C, 20D of two subsequent perforated plates 12A, 12B, 12C, 12D are staggered with respect to each other.

Additionally, the number of holes 20B of the at least one second perforated plate 12B is equal to, or is a multiple of, the number of the tubes of the tube bundle 100, or the number of the channels in case of a heat exchanger provided with open channels. The holes 20B of the at least one second perforated plate 12B are thus placed at the inlet mouth of corresponding tubes or channels.

The correct number of perforated plates 12A, 12B, 12C, 12D to be assembled in the fluid distributor assembly 10 should be selected according to the following conditions:

- the particular geometric configuration of the heat exchanger head portion 126 at which the fluid distributor assembly 10 will be placed;
- the specific range of operating conditions for which the heat exchanger and the fluid distributor assembly 10 are designed, i.e. the refrigerant types, the mass flow rate values and the required pressure drop to have a low inlet vapor quality value;
- the minimum thickness of the perforated plates 12A, 12B, 12C, 12D in a specific geometry, such as to ensure a negligible deformation under bending actions; and
- the minimum diameter of the through holes 20A, 20B, 20C, 20D that can be obtained on the perforated plates 12A, 12B, 12C, 12D in an economic way once defined the plate thickness.

Generally, the first two conditions are peculiar and fixed for a specific type of shell-and-tube equipment in a given wide field of use of a specific application (e.g. dry expansion evaporators, single-pass tube, to be used in refrigeration circuits with HFC/HFO refrigerants for air-conditioning applications).

The fluid distributor assembly 10 according to the present invention can be easily designed for an optimal fluid distribution system for each specific application by simply changing the following parameters:

- the diameter of the through holes 20A, 20B, 20C, 20D of each perforated plate 12A, 12B, 12C, 12D;
- the thickness of each perforated plate 12A, 12B, 12C, 12D;
- the depth of each equalization chamber 14;
- the total number of perforated plates 12A, 12B, 12C, 12D and of the corresponding equalization chambers 14.

Due to the high number of variables involved, it is possible, once the specific type of application and the rough geometry of the heat exchanger are chosen, to define and establish some parameters, in order to reduce the variables: the result will be a standardization of the most expensive sub-components of the fluid distributor assembly 10. An example would be: establish the number of perforated plates 12A, 12B, 12C and the number of the corresponding equalization chambers 14, establish the thickness of the perforated plates 12A, 12B, 12C and the depth of each equalization chamber 14, whereas the diameter of the through holes 20A, 20B, 20C, 20D of each perforated plate 12A, 12B, 12C, 12D is left as the sole variable parameter of the fluid distributor assembly 10.

Figure 13:
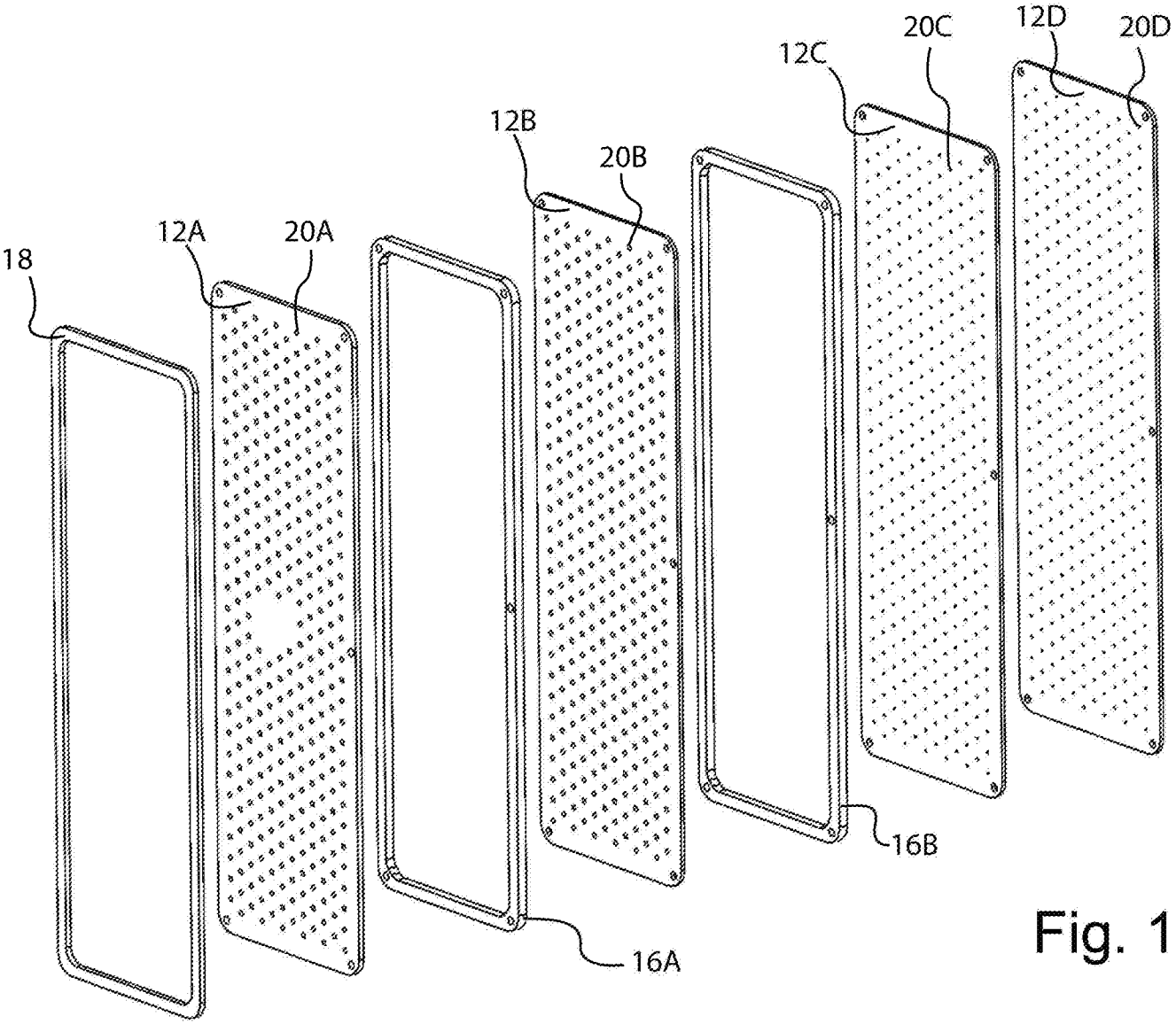
FIG. 13 is an exploded view of the fluid distributor assembly of FIG. 12.
Figure 16A:
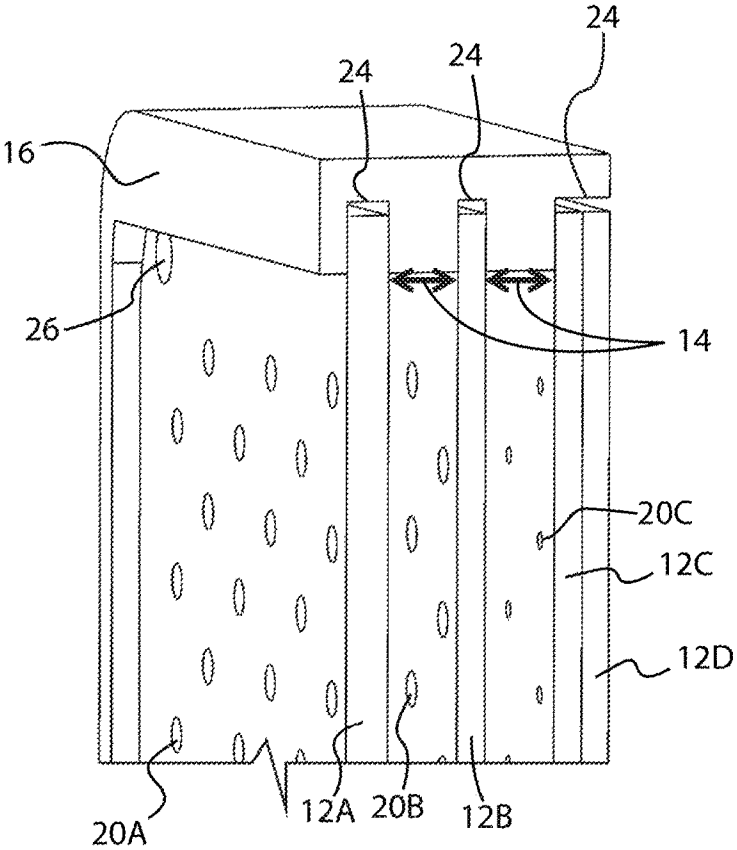
FIG. 16A is an enlarged view of a detail of FIG. 16.
Figure 16:
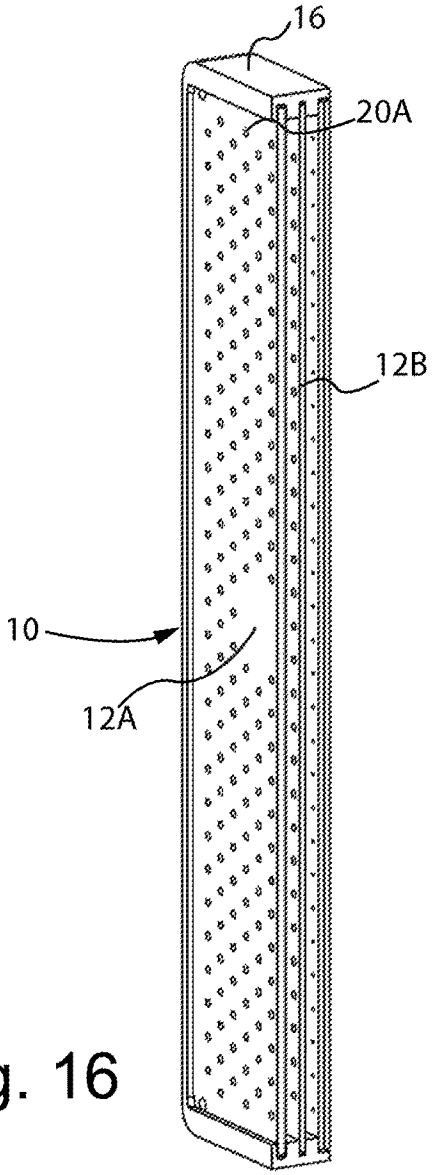
FIG. 16 shows a possible sealing configuration for the plates of the fluid distributor assembly according to the present invention.

If the manufacturing cost of the fluid distributor assembly 10 will not be too affected, another possibility could be to vary the thickness of the perforated plates 12A, 12B, 12C, 12D in order to achieve the goal of having high pressure drops. The thickness increase can be obtained on each single perforated plate 12A, 12B, 12C, 12D. Alternatively or additionally, as shown in FIGS. 13 and 16, one or more of the perforated plates of the fluid distributor assembly 10 can be obtained by the overlap of two or more identical perforated sheets 12C, 12D, 12E (FIG. 20) of low thickness, wherein each perforated sheet 12C have through holes 20C of the same number, with the same layout and, according to one preferred embodiment, of the same diameter of the corresponding through holes 20D, 20E of the other perforated sheets 12D, 12E.

With reference to FIGS. 12-15, a preferred embodiment of the fluid distributor assembly 10 is provided with a pre-chamber 22 interposed between the head portion 126 of the heat exchanger and the first perforated plate 12A of the fluid distributor assembly 10. At least a gasket 18 is interposed between the head portion 126 of the heat exchanger and the first perforated plate 12A of the fluid distributor assembly 10. The gasket 18 surrounds and seals the pre-chamber 22 with respect to the head portion 126 of the heat exchanger and the first perforated plate 12A of the fluid distributor assembly 10.

The preferred embodiment of the fluid distributor assembly 10 thus comprises three perforated plates 12A, 12B and 12C-12D, wherein the third perforated plate 12C-12D is obtained by the overlap of two identical perforated sheets 12C and 12D. Two ring-spacers 16A and 16B are respectively provided between the first perforated plate 12A and the second perforated plate 12B, and between the second perforated plate 12B and the third perforated plate 12C-12D. The ring-spacers 16A and 16B form two corresponding equalization chambers 14.

Figure 14:
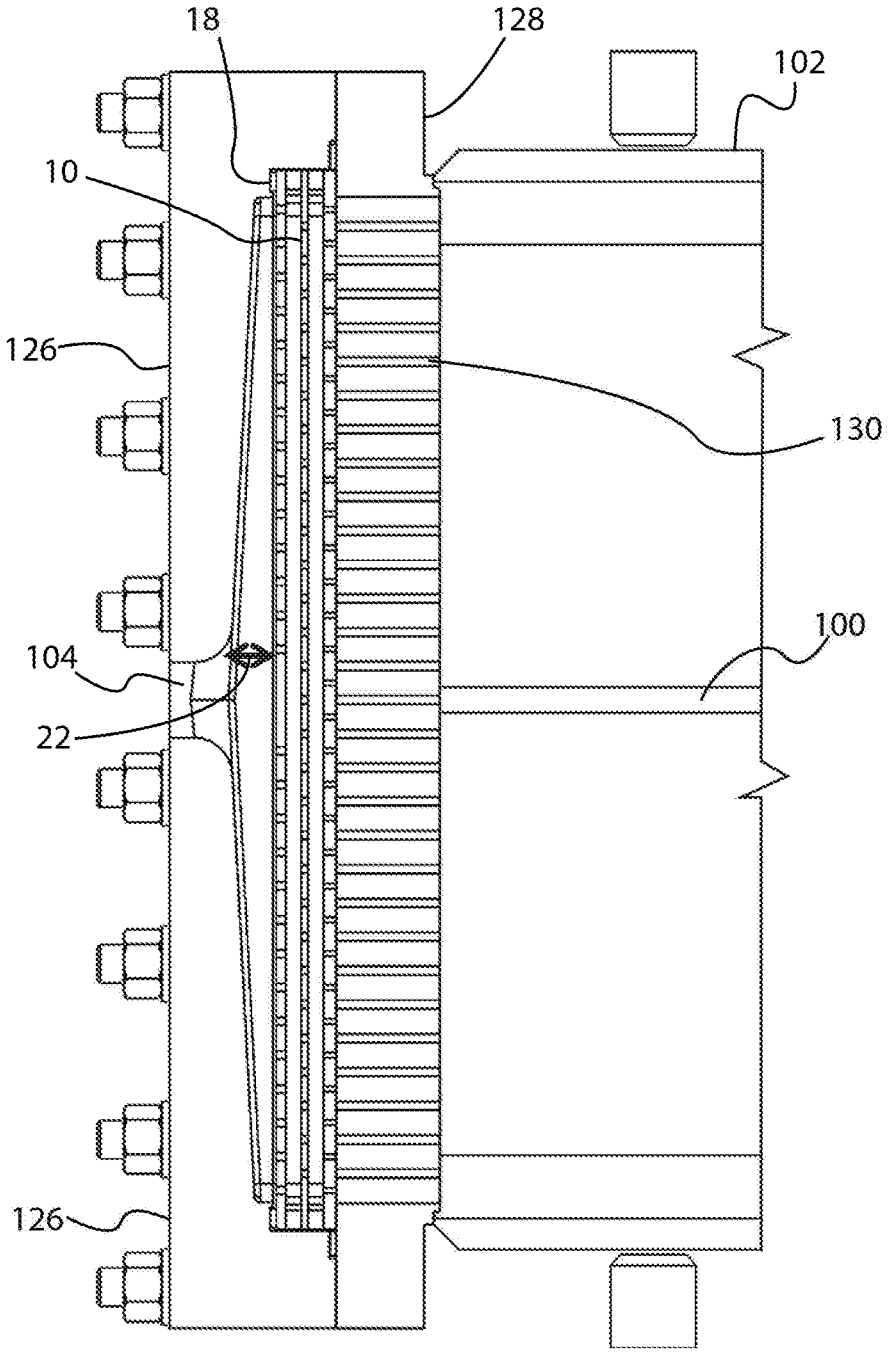
FIGS. 14 and 15 show the fluid distributor assembly positioned in the inlet head of a dry expansion evaporator.
Figure 15:
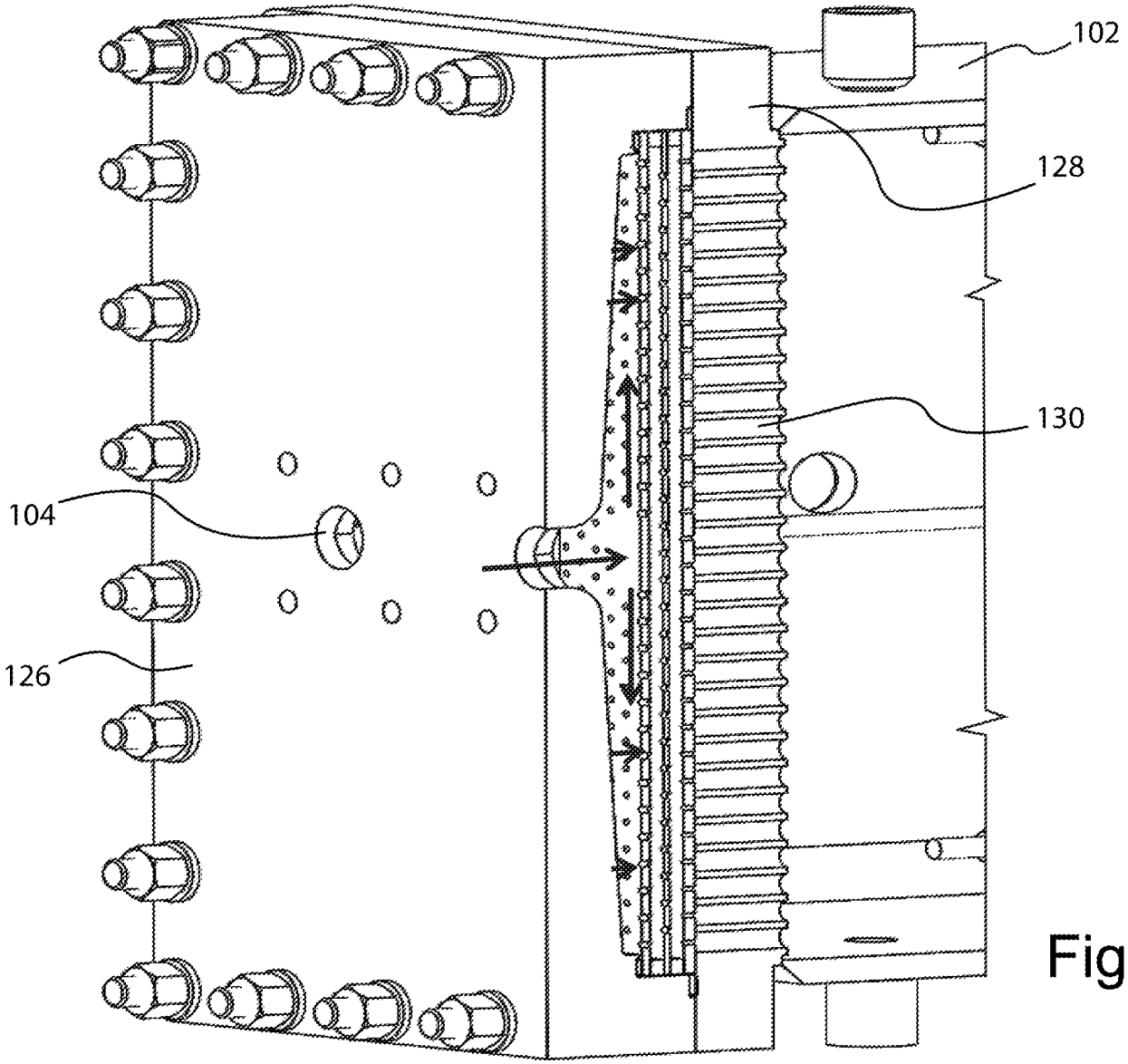

In FIGS. 14 and 15 an example of positioning of the fluid distributor assembly 10 in a head portion 126 or inlet head of a heat exchanger is shown. More specifically, the head portion 126 is the inlet head of a shell-and-tube dry-expansion evaporator.

The hermetic sealing of the equalization chambers 14 shown in FIGS. 12-15 is obtained by brazing using copper foils. In this configuration the perforated plates 12A, 12B, 12C, 12D and the ring-spacers 16A, 16B are manufactured with carbon steel material.

Another possible type of sealing between the perforated plates 12A, 12B, 12C, 12D can be obtained with a single resilient case 16 configured for surrounding the peripheral edges of the first perforated plate 12A and of the at least one second perforated plate 12B. The resilient case 16 is preferably manufactured with rubber through a molding process. The resilient case 16 is provided with a plurality of inner peripheral grooves 24 in which the peripheral edges of corresponding perforated plates 12A, 12B, 12C, 12D can be housed. The particular geometry of the resilient case 16 mold makes possible that the same resilient case 16 acts as a spacer between the subsequent perforated plates 12A, 12B, 12C, 12D, creating the closed equalization chambers 14. This solution is shown in FIGS. 16 and 16A.

Both types of sealing assembly between the perforated plates 12A, 12B, 12C, 12D allow certain advantages in terms of manufacturing costs. Actually, it is possible to couple together two or more perforated sheets 12C, 12D, 12E of equal thickness and with a low thickness with respect to the thickness of the perforated plates 12A, 12B, 12C, 12D, with the advantage of keeping low the drilling costs (for example using punching instead of laser). In case of assembly by brazing, each pair of perforated sheets 12C, 12D, 12E can be joined at their peripheral edges by a thin copper sheet, positioned between the two perforated sheets 12C, 12D, 12E before brazing. The copper sheet is suitably shaped in such a way that the molten copper in excess will not obstruct the through holes 20C, 20D, 20E of the perforated sheets 12C, 12D, 12E.

In case of assembling using a resilient case 16, appropriate plugs (not shown) that will work for interference can be used to join together the perforated plates 12A, 12B, 12C, 12D. The plugs can be inserted into corresponding plug bores 26 obtained on the peripheral edge of each perforated plate 12A, 12B, 12C, 12D, in order to keep the correct contact, as well as the through holes 20A, 20B, 20C, 20D alignment, between the coupled perforated plates 12A, 12B, 12C, 12D.

It is possible to maintain a standardization of the perforated plates 12A, 12B, 12C, 12D using the same product code for different configurations. For example, once some relevant dimensions of a heat exchanger have been set out, i.e., in the case of a tube bundle heat exchanger, once the diameter of the shell 102 and the geometry of the inlet head portion 126 have been set out, the fluid distributor assembly 10 will include a number of configurations equal to the number of heat exchanger embodiments that are obtained by varying the number of the respective tubes or channels.

Figure 17C:
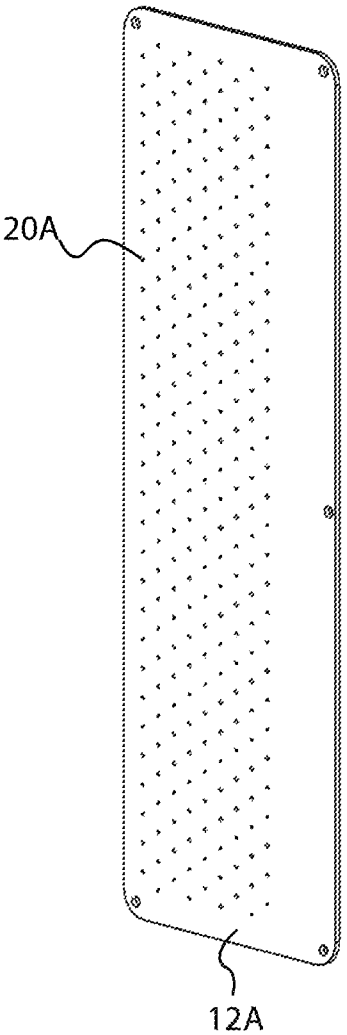
FIGS. 17A-17F show a number of possible configurations for the plates of the fluid distributor assembly according to the present invention.
Figure 17B:
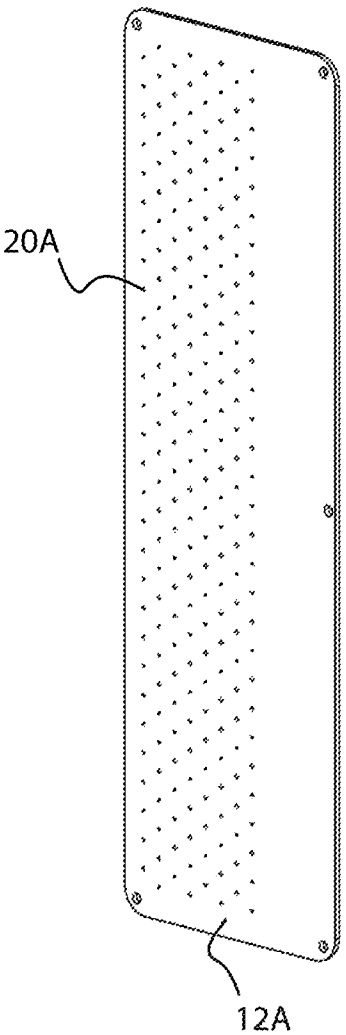
Figure 17A:
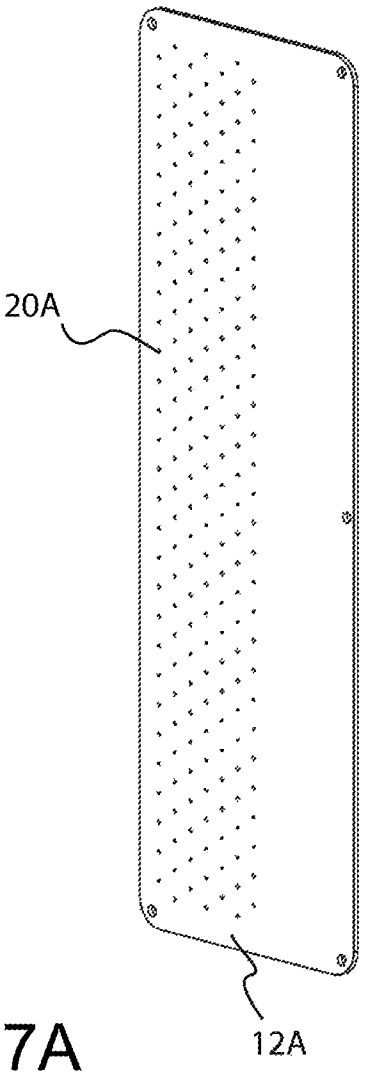

A number of configurations of the through holes 20A, 20B, 20C, 20D layout is available for each perforated plate 12A, 12B, 12C, 12D. For example, considering the embodiments of FIGS. 17A-17F, once the thickness of each perforated plate 12A, 12B, 12C, 12D and the depth of each equalization chamber 14 have been set out, the through holes 20A, 20B, 20C, 20D number and diameter for each perforated plate 12A, 12B, 12C, 12D may be chosen. More specifically, the perforated plate 12A of FIG. 17A is provided with seven columns of through holes 20A and is designed for a heat exchanger having seven rows of tubes or channels. The perforated plate 12A of FIG. 17B is provided with eight columns of through holes 20A and is designed for a heat exchanger having eight rows of tubes or channels. The perforated plate 12A of FIG. 17C is provided with nine columns of through holes 20A and is designed for a heat exchanger having nine rows of tubes or channels. The perforated plate 12A of FIG. 17D is provided with ten columns of through holes 20A and is designed for a heat exchanger having ten rows of tubes or channels. The perforated plate 12A of FIG. 17E is provided with eleven columns of through holes 20A and is designed for a heat exchanger having eleven rows of tubes or channels. Finally, the perforated plate 12A of FIG. 17F is provided with twelve columns of through holes 20A and is designed for a heat exchanger having twelve rows of tubes or channels.

Alternatively or in addition, a single number and/or layout of through holes 20A, 20B, 20C, 20D of each perforated plate 12A, 12B, 12C, 12D may be set out. In this configuration, at least part of the ring-spacers 16A, 16B may be provided with at least one separation wall 28 of variable height and length. Each separation wall 28 is configured for reducing the volume of the respective equalization chamber 14 and for covering at least part of the through holes 20A, 20B, 20C, 20D of the respective perforated plate 12A, 12B, 12C, 12D placed downstream of said separation wall 28. Different layouts of the ring-spacers 16A, 16B are thus possible.

Figure 17F:
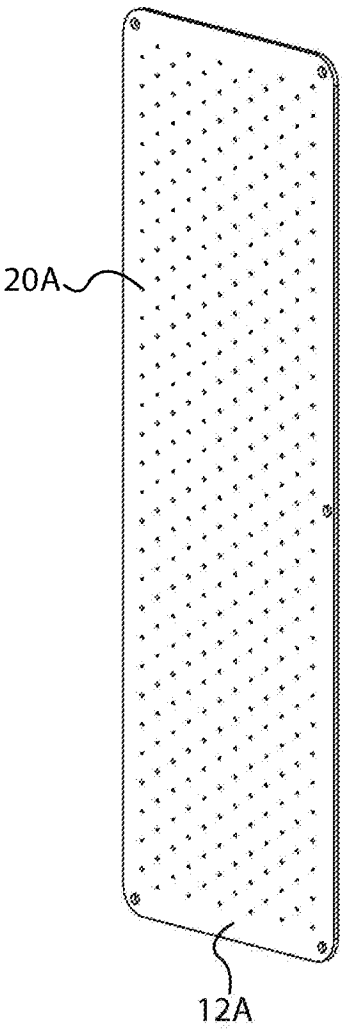
Figure 17E:
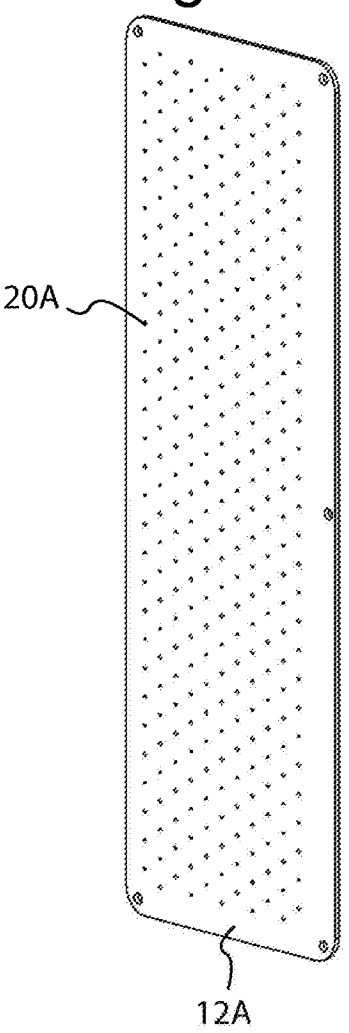
Figure 17D:
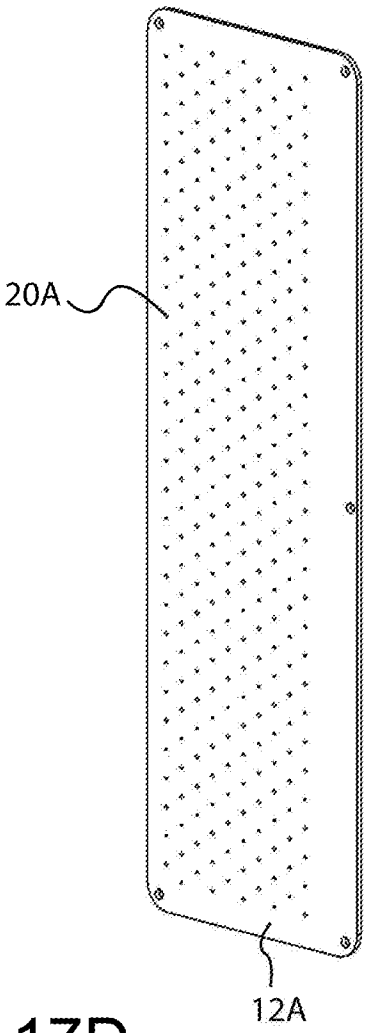
Figure 18C:
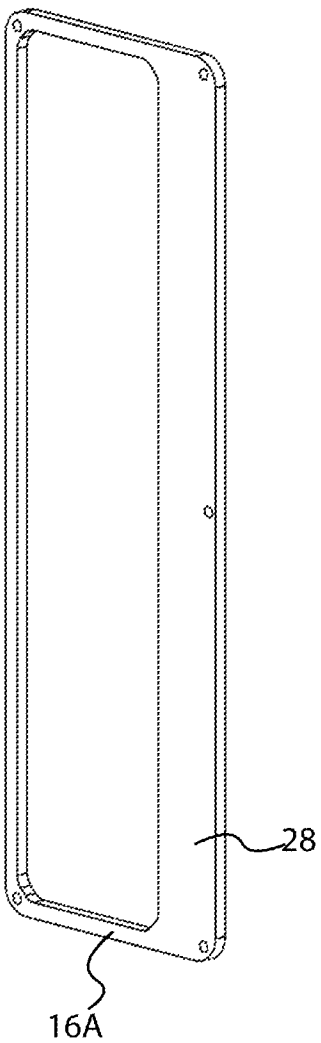
FIGS. 18A-18F shows a number of possible configurations for ring-spacer elements of the fluid distributor assembly according to the present invention.
Figure 18B:
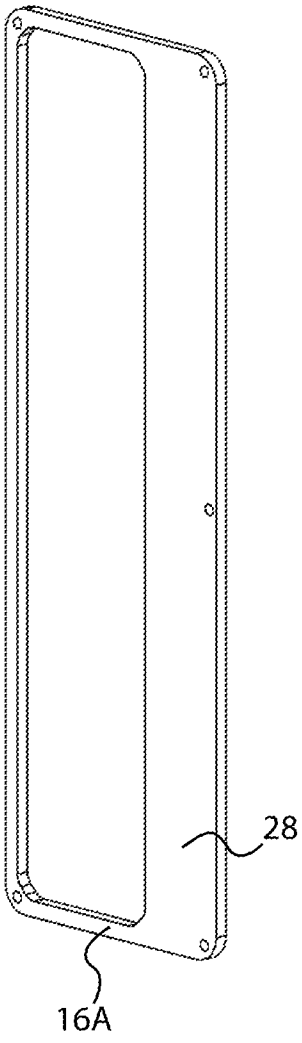
Figure 18A:
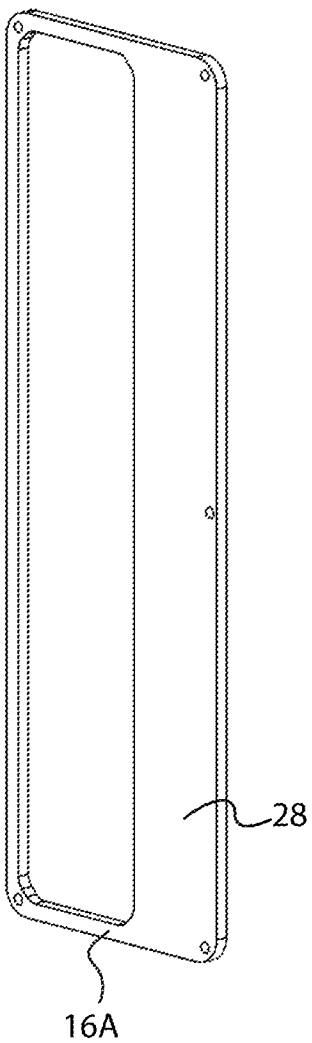
Figure 18F:
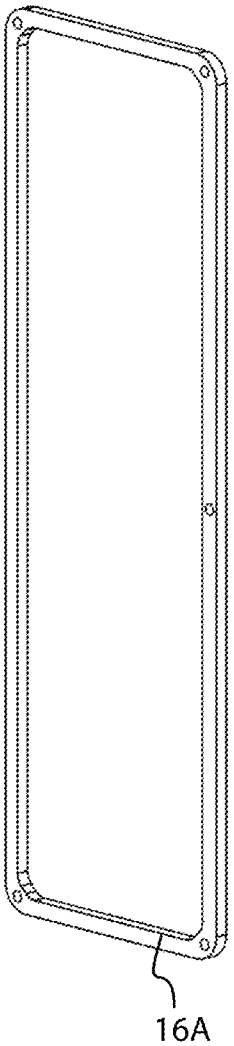
Figure 18E:
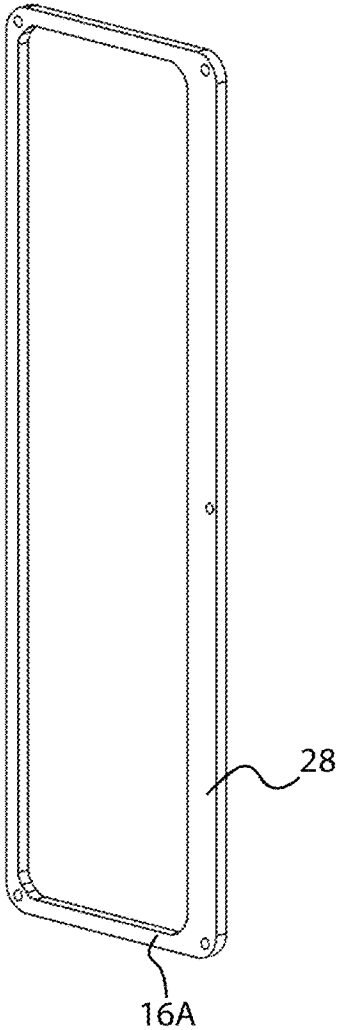
Figure 18D:
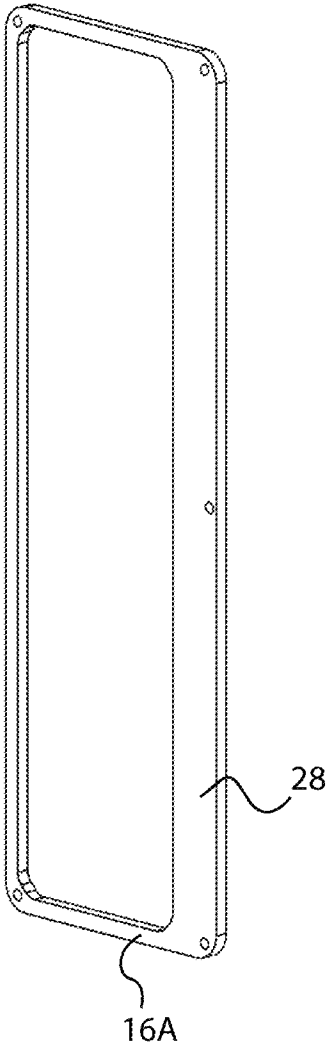

For example, starting from the perforated plate 12A of FIG. 17F, the ring-spacer 16A of FIG. 18A has a separation wall 28 that is designed to cover five columns of through holes 20A of the fully perforated plate 12A. The ring-spacer 16A of FIG. 18B has a separation wall 28 that is designed to cover four columns of through holes 20A of the fully perforated plate 12A. The ring-spacer 16A of FIG. 18C has a separation wall 28 that is designed to cover three columns of through holes 20A of the fully perforated plate 12A. The ring-spacer 16A of FIG. 18D has a separation wall 28 that is designed to cover two columns of through holes 20A of the fully perforated plate 12A. The ring-spacer 16A of FIG. 18E has a separation wall 28 that is designed to cover one column of through holes 20A of the fully perforated plate 12A. Finally, the ring-spacer 16A of FIG. 18F has no separation walls 28: all the through holes 20A of a perforated plate 12A placed downstream of said ring-spacer 16A are thus fully uncovered.

Figure 20:
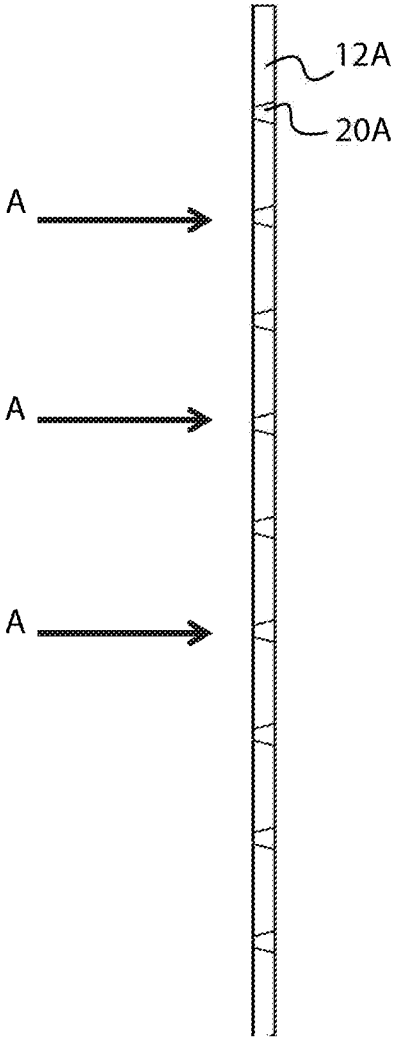
FIG. 20 shows a second possible configuration of the plate holes of the fluid distributor assembly according to the present invention.
Figure 19:
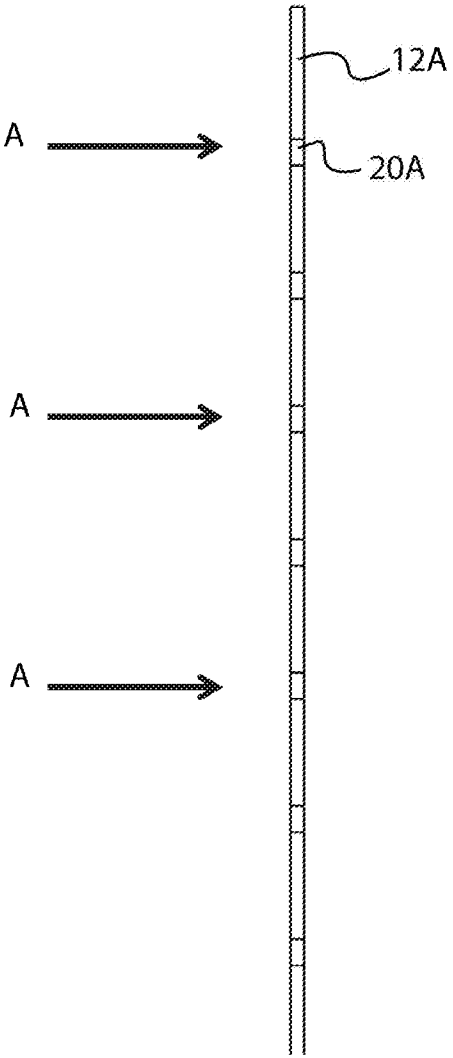
FIG. 19 shows a first possible configuration of the plate holes of the fluid distributor assembly according to the present invention.

Another advantage of a possible configuration of the fluid distributor assembly 10 according the present invention is due to the reduction, or even the elimination, of the reverse flow instability problem that may occur in some heat exchangers. For this purpose, at least part of the through holes 20A, 20B, 20C, 20D of one or more perforated plates 12A, 12B, 12C, 12D can have, instead of a cylindrical-shape as shown in FIG. 19, a conical-shape section that widens in the flow direction A of the first fluid flowing into said through holes 20A, 20B, 20C, 20D. In other words, each of these through holes 20A, 20B, 20C, 20D forms a corresponding diverging conduit, as shown in FIG. 20.

Figure 21:
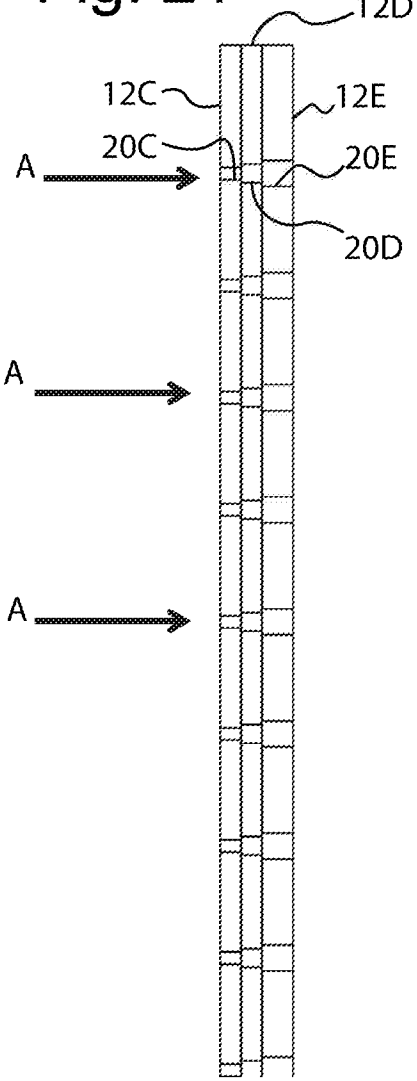
FIG. 21 shows a third possible configuration of the plate holes of the fluid distributor assembly according to the present invention.

Each diverging conduit can be obtained by punching or by laser machining for a single plate 12A, 12B, 12C, 12D. Alternatively or in addition, each diverging conduit can be obtained by coupling two or more perforated sheets 12C, 12D, 12E with the same number of through holes 20C, 20D, 20E, wherein the diameter of the holes 20C of a first perforated sheet 12C is smaller than the diameter of the corresponding through holes 20D, 20E of the subsequent perforated sheets 12D, 12E, with reference to the flow direction A of the first fluid flowing into said through holes 20C, 20D, 20E, as shown in FIG. 21.

It is thus seen that the fluid distributor assembly for a heat exchanger according to the present invention achieves the previously outlined objects.

The fluid distributor assembly for a heat exchanger of the present invention thus conceived is susceptible in any case of numerous modifications and variants, all falling within the same inventive concept; in addition, all the details can be substituted by technically equivalent elements. In practice, the materials used, as well as the shapes and size, can be of any type according to the technical requirements.

The protective scope of the invention is therefore defined by the enclosed claims.

The invention claimed is:

1. A heat exchanger comprising:

a shell having an elongated shape and a cylindrical geometry, wherein a first fluid, fed through one or more first inlet pipes obtained in a head portion of the heat exchanger, flows inside the shell and a second fluid, fed through at least one second inlet pipe, flows inside the shell in order to perform heat exchange with the first fluid, and wherein the heat exchanger also comprises a fluid distributor assembly placed at said one or more first inlet pipes, the heat exchanger having a first perforated plate, in turn provided with first through holes, and having at least one second perforated plate, in turn provided with second through holes, wherein the at least one second perforated plate is disposed parallel and downstream of the first perforated plate with respect to the flow direction of the first fluid flowing into the first through holes and the second through holes, wherein, between the first perforated plate and the at least one second perforated plate, a hermetic seal is disposed, and wherein the first perforated plate and the at least one second perforated plate are spaced from each other, in such a way that the first perforated plate and the at least one second perforated plate, together with the hermetic seal, surround an equalization chamber of predefined depth, measured along the flow direction of the first fluid flowing into the first through holes and the second through holes, the equalization chamber being closed at the peripheral edges of the first perforated plate and of the at least one second perforated plate.

2. The heat exchanger according to claim 1, wherein at least a gasket is interposed between the head portion and the first perforated plate, said gasket surrounding and sealing a pre-chamber interposed between said head portion and said first perforated plate.

3. The heat exchanger according to claim 1, further comprising a plurality of tubes arranged parallel to each other in order to form one or more tube bundles, wherein each tube bundle is axially inserted into the shell and wherein the first fluid flows inside the one or more tube bundles and the second fluid flows inside the shell in order to perform heat exchange with the first fluid through the walls of the tubes of the one or more tube bundles.

4. The heat exchanger according to claim 3, wherein at least one end of each tube of the one or more tube bundles is joined to an inlet tube-sheet, disposed downstream of the head portion, and wherein the fluid distributor assembly is placed between the head portion and the inlet tube-sheet.

5. The heat exchanger according to claim 3, wherein the number of through holes of the at least one second perforated plate is equal to, or is a multiple of, the number of the tubes of the tube bundle, wherein the through holes of said at least one second perforated plate are placed at the inlet mouth of corresponding tubes of the tube bundle.

6. The heat exchanger according to claim 1, wherein the hermetic seal consists of one or more ring-spacers each disposed between two adjacent perforated plates of the first perforated plate and the at least one of the second perforated plate at their peripheral edges.

7. The heat exchanger according to claim 6, wherein at least part of the one or more ring-spacers is provided with at least one separation wall of variable height and length, each separation wall being configured for reducing the volume of the respective equalization chamber and for covering at least part of the through holes of the respective perforated plate placed downstream of said separation wall.

8. The heat exchanger according to claim 1, wherein the hermetic seal consists of a single resilient case configured for surrounding the peripheral edges of the first perforated plate and of the at least one second perforated plate.

9. The heat exchanger according to claim 8, wherein the resilient case is provided with a plurality of inner peripheral grooves in which the peripheral edges of corresponding perforated plates are housed.

10. The heat exchanger according to claim 1, wherein the first through holes of the first perforated plate are staggered with respect to the second through holes of the at least one second perforated plate.

11. The heat exchanger according to claim 1, wherein one or more perforated plates of the first perforated plate and the at least one of the second perforated plate are obtained by the overlap of two or more perforated sheets, wherein each perforated sheet have through holes of the same number and with the same layout of the corresponding through holes of the other perforated sheets.

12. The heat exchanger according to claim 11, wherein each perforated sheet has through holes of the same diameter of the corresponding through holes of the other perforated sheets.

13. The heat exchanger according to claim 11, wherein the diameter of the through holes of a first perforated sheet of the two or more perforated sheets is smaller than the diameter of the corresponding through holes of a subsequent perforated sheet, with reference to the flow direction of the first fluid flowing into said through holes, in such a way that said through holes, from the first perforate sheet to the subsequent perforated sheet, form a corresponding diverging conduit.

14. The heat exchanger according to claim 1, wherein one or more of the through holes of the first perforated plate or the at least one second perforated plate has a conical-shape section that widens in the flow direction of the first fluid flowing into said through holes, in such a way that each of said through holes forms a corresponding diverging conduit.

* * * * *